United States Patent [19]

Schoeller

[11] 4,038,803

[45] Aug. 2, 1977

[54] METHOD FOR STRAIGHTENING JOISTS

[76] Inventor: Siegmund Schoeller, 9 Darke Crescent, Regina, Saskatchewan, Canada, S4S 2W5

[21] Appl. No.: 657,287

[22] Filed: Feb. 11, 1976

[30] Foreign Application Priority Data

Oct. 23, 1975 Canada ..... 238206

[51] Int. Cl.[2] ..... E04G 23/00

[52] U.S. Cl. ..... 52/741; 52/291; 52/695

[58] Field of Search ..... 52/291, 514, 758 G, 52/226, 225, 223 R, 723, 695, 657, 697, 650, 741

[56] References Cited

U.S. PATENT DOCUMENTS

| | | | |
|---|---|---|---|
| 573,452 | 12/1896 | Delahunt | 52/223 R |
| 1,009,996 | 11/1911 | Rifflard | 52/695 |
| 1,099,749 | 6/1914 | Hungerford | 52/291 |
| 1,523,711 | 1/1925 | Powell | 52/695 |
| 1,734,701 | 11/1929 | White | 52/741 |
| 2,099,589 | 11/1937 | Armbruster | 52/695 |
| 2,181,702 | 11/1939 | Masoner | 52/758 G |
| 2,856,644 | 10/1958 | Dunham | 52/291 |
| 2,914,816 | 12/1959 | Lundgren | 52/758 G |
| 2,964,807 | 12/1960 | Kennedy | 52/696 |
| 3,247,635 | 4/1966 | Burns | 52/223 L |

FOREIGN PATENT DOCUMENTS

| | | | |
|---|---|---|---|
| 552,823 | 2/1958 | Canada | 52/695 |
| 667,417 | 2/1952 | United Kingdom | 52/695 |

*Primary Examiner*—Price C. Faw, Jr.
*Assistant Examiner*—Henry Raduazo
*Attorney, Agent, or Firm*—Cushman, Darby & Cushman

[57] ABSTRACT

Horizontally uneven wooden floor joists are each provided with a horizontal opening extending transversely thereof. A connecting rod member is inserted into such opening so that the ends of the rod protrude to both sides of the joist, the rod itself extending generally horizontally. The connecting rods are then subjected to tension forces generated by adjustable tension means of the type of a rod-and-buckle mechanism anchored to other connecting rod members provided in adjacent joists. The invention thus provides an extremely simply straightening method and apparatus avoiding the common cutting of high or low floor joists at their crest or dip and replacing the cut-out portion by a new joist.

3 Claims, 4 Drawing Figures

METHOD FOR STRAIGHTENING JOISTS

The present invention relates to a method and apparatus for straightening of a horizontally uneven floor joist made of lumber. The present methods used in straightening of joists of this type consists, basically, of cutting the high or low joists off approximately at or near the end of the crest, in the case of a high joist, or the dip, in the case of a low joist, and replacing the portion of the joist cut-out by a new joist.

The above described method has long been used in practice, despite the fact that different types of straightening of members such as door or joists had already been proposed. Thus, U.S. Pat. No. 3,471,973 issued on Oct. 14, 1969 shows a door straightener kit arranged to be attached to a warped door and to apply appropriate tension to same by means of brace rods associated with a turnbuckle.

Another proposal, disclosed in U.S. Pat. No. 2,856,644, issued on Oct. 21, 1958, discloses a joist brace adapted to be attached as an intermediate reinforcement of floor joists to control the sagging of same.

While the former patent is specifically designed for flat objects such as doors and thus requires a relatively low stretching force, the drawback of the solution described in U.S. Pat. No. 2,856,644 is that it is specifically designed for reinforcement of sagging joists without the possibility of applying the device to a high joist of a partly assembled floor in which the sub-floor has already been secured to the top of the joists. It is known that in practice, the need for straightening the high or low joists frequently arises at different stages of production of the floor assembly.

Consequently, it is an object of the present invention to provide a novel method and apparatus for straightening floor joists which is relatively inexpensive, which can be readily attached to the floor joists and, above all, which can be attached to appropriate joists at virtually any stage of the production of a floor assembly.

According to the invention, a method is provided for straightening of a horizontally uneven floor joist made of lumber and comprised in a joist assembly. The joist assembly normally defines a first generally horizontal level and a second generally horizontal level, the levels being vertically spaced apart and being defined by top and bottom surfaces, respectively of the joists comprised in the assembly. Obviously, one of the levels is the top or floor level, while the other level is that of the bottom horizontal surfaces of the floor joists. The method comprises the steps of providing the uneven joist at said first generally horizontal level with a transversely extending horizontal opening. An elongated connecting rod member is then inserted into such opening with the ends of the connecting rod member protruding to both sides of the uneven joist. The connecting rod is inserted adjacent one of the said generally horizontal levels. Tension forces are then applied to the rod member, the forces being directed in generally opposite direction to each other, each of the forces being directed away of the respective side of the uneven joist and towards the other of said generally horizontal levels.

The application of the tension forces is effected by adjustable tension means anchored to joists of said assembly located to both sides of said uneven joist. The anchoring of the tension means is effected in the area adjacent to the second of the two generally horizontal levels.

The apparatus according to the present invention is, in broad terms, a straightener for use in the above method and including a connecting rod member adapted to be received in an opening provided in said uneven joist at the first horizontal surface thereof, wnhereby the rod assumes a generally horizontal position laterally across said joint with terminal portions of said connecting member extending to both sides of the uneven joist. Each of the terminal portions of the connecting rod member is provided with connection means, such as hook receiving openings, for securing the terminal portion to respective ends of tension means. The respective opposite ends of each of the tension means are arranged to be anchored to a second and to a third joist, respectively, at said second generally horizontal level. Horizontal brace means are disposed between the joists for preventing lateral movement of the joists with respect to each other. In general terms, the brace means is adapted to be located between the first, second and third joists at a level which is adjacent to said second, generally horizontal level.

The invention will now be described in greater detail with reference to the accompanying schematic drawings.

Figure 1:
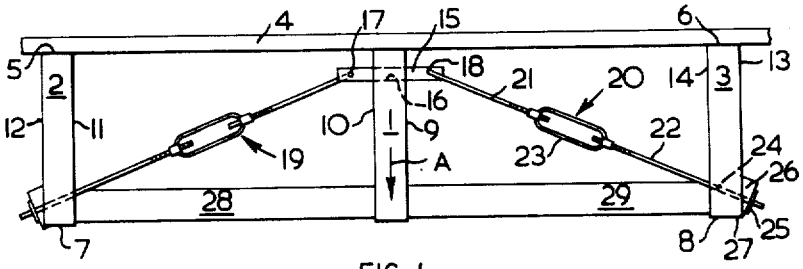
FIG. 1 is a schematic end view of a floor sub-assembly showing the apparatus according to the present invention applied to one embodiment of the method.

Turning now to the embodiment of FIG. 1, it will be observed that the figure shows floor joists 1, 2, 3 of a floor sub-assembly which includes a sub-floor 4 which is shown already attached to the joists 1 - 3.

It is to be appreciated that the joist 1, which is shown in generally coplanar relationship, is what is hereinafter referred to as horizontally uneven joist 1 as the coplanar relationship of the top surfaces of joists 1, 2 and 3 as shown in FIG. 1 is only due to the tension applied by the straightener which will hereinafter be described in greater detail. In other words, if the straightener were not applied, the top horizontal surface of joist 1 would produce a crest (somewhat similar to FIG. 4) extending over the horizontal plane defined by joists 2 and 3. It will thus be appreciated that the joists 2 and 3 define two generally horizontal planes: one plane is that coincident with the top horizontal surfaces 5, 6 of joists 2, 3, the other being that coincident with the bottom horizontal surfaces 7, 8 of joists 2, 3. In general, the horizontal surfaces 5, 6, 7, 8 of joists 2, 3 define a first generally horizontal level (coincident with 5 - 6 or 7 - 8) and a second generally horizontal level (coincident with 7 - 8 or 5 - 6 respectively). The levels are vertically spaced from each other. It will further be apparent from FIG. 1 that each of the joists has two generally vertical side surfaces. Thus, joist 1 has side surface 9, 10, joist 2 has side surfaces 11, 12 and joist 3 has side surfaces 13, 14.

Turning now to the straightener itself, it will be observed that the straightener comprises basic elements as described hereinafter. A connecting rod member 15 is inserted in an opening 16 which extends horizontally through joist 1 at the upper horizontal surface thereof. The rod 15 thus assumes a generally horizontal position and extends laterally across the joist 1. The rod 15 is a circular, steel rod provided at both ends thereof with openings 17, 18. The rod 15 is slidable within the opening 16 and can be shifted to either side as viewed in FIG. 1. In broad terms, therefore, the rod member 15 can be defined as having terminal portions provided with connection means (openings 17, 18) for securing each of the terminal portions to respective ends of tension means.

The tension means referred to hereinbefore are of the type of pair of rod-and-turnbuckle device designated with reference numbers 19, 20, respectively (FIG. 1). Inasmuch as the rod-and-turnbuckle devices correspond to each other, only the right hand side assembly 20 will now be described in greater detail. The means 20 including two stubs 21, 22 with a turnbuckle 23 disposed therebetween. The stub 21 is provided at its free end with a hook 23 (FIG. 2) which is shown as being received in the opening 18. The straight end stub 22 extends to the anchoring end of the rod-and-turnbuckle device 20 and includes elements which are, in general terms, referred to as anchoring means and which will now be described in greater detail. The anchoring means includes a straight, threaded end 24 which passes through an oblique opening provided in floor joist 3, extending through same beyond its surface 13. The threaded end 24 is provided with an end nut 25. A wedge shaped washer 26 is interposed between the nut 25 and the side 13 of the joist 3. The wedge shaped washer 26 is provided with an end nose portion 27 which, as seen from FIG. 1, extends from its surface facing the side 13 of joist 3 and embraces a portion of the horizontal surface 8 of joist 3 to prevent the washer 26 from sliding along the surface 13 in upward direction as viewed in FIG. 1, thus reinforcing the anchoring joist.

It will be observed that the left hand side rod-and-turnbuckle device 19 is, basically, a mirror image of that designated with reference numeral 20. It can thus be said that the respective opposite ends of each of said tension means 19, 20 are arranged to be anchored to a second and third joist 2, 3, respectively, at a second horizontal level, coincident with the surfaces 7, 8 of joists 2, 3.

Horizontal brace members 28, 29, are disposed between joists 2, 1 and 1, 3, respectively. The members 28, 29 are two inches by two inches pieces of lumber of appropriate length and prevent lateral movement of joists 1, 2, 3 with respect to each other. As best seen in FIG. 1, the brace means 28, 29 are located at a level adjacent to the horizontal level defined by surfaces 7, 8 of joists 2, 3. In general terms, therefore, the brace means can also be defined as being located at a level adjacent to the second horizontal level as mentioned hereinabove.

It will be observed, that in the embodiment of FIG. 1 and FIG. 2, the first horizontal level as herinbefore or hereinafter referred to is the top level defined by surfaces 5, 6 of joists 2, 3, while the second horizontal level is the lower level generally coincident with surfaces 7, 8 of joists 2, 3.

It will be apparent that FIG. 1 shows one embodiment of the application of the present invention wherein it is desired to level the uneven joist 1 by forcing its crest portion downwardly, in the direction of arrow A (FIG. 1).

Figure 3:
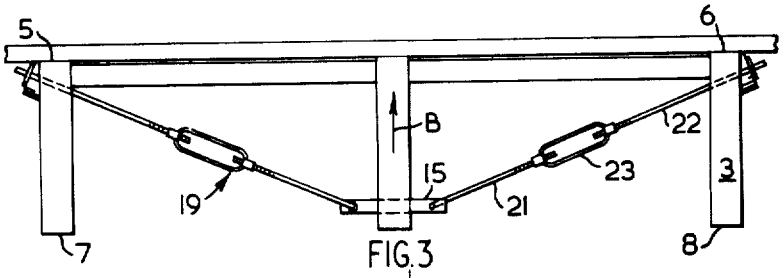
FIG. 3 is a view, similar to that of FIG. 1, showing another embodiment of method of the present invention.

Turning now to FIG. 3, the parts corresponding to those of FIG. 1 have been referred to with the same reference numerals for the sake of clarity. It will be observed that in the embodiment of FIG. 3, the rod member 15 is located adjacent a horizontal level defined by lower surfaces 7, 8 of joists 2, 3, while the anchoring portions of respectively rod-and-turnbuckle means 19, 20, together with the respective brace members 28, 29 are located adjacent the level defined by top surfaces 5, 6 of joists 2, 3. Thus, referring to the general terminology using the terms of "first horizontal level" and "second horizontal level" it will be seen that in FIG. 3, the "first" level is that generally coincident with surfaces 7, 8, while the "second" level is that of surfaces 5, 6 as referred to hereinbefore.

It will be apparent that the method and apparatus as applied in accordance with FIG. 3 is used in lifting an uneven joint 1 to bring its sagging top surface into coplanar relationship with surfaces 5, 6.

Figure 2:
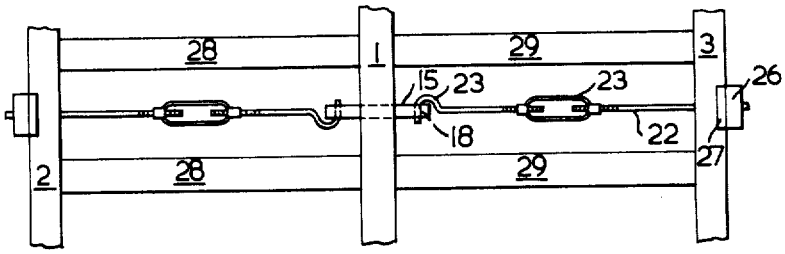
FIG. 2 is a bottom view of the embodiment shown in FIG. 1.

Both the embodiment of FIG. 1 and that of FIG. 2 are shown as applied to a partly erected floor assembly, with the sub-floor 4 already attached to the top surfaces of joists 1, 2 and 3.

In operation, and assuming that the unevenness of joist 1 has become apparent after securing the sub-floor 4 to the joist 1, 2, 3, the opening 16 is first drilled in the uneven joist 1, depending on the type of unevenness of such joist, the opening is drilled either at its upper or lower level (FIG. 1, FIG. 2, respectively). The rod member 15 is then inserted into the drilled opening and appropriate holes are drilled through the adjacent joists 2, 3 for receiving the threaded ends 24 of the rod-and-turnbuckle devices 19, 20. The stubs 21, 21 of the turnbuckle means are then installed with the end nuts 25 and washers 26 is appropriate position. The brace memeber 28, 29 are then suitably secured to appropriate portions of the joists 1, 2, 3 and the straightening is then effected by tightening the turnbuckle 23 of respective means 19, 20.

Those skilled in the art will appreciate that the sequence of the steps of the above described method need not necessarily be the same as described. For instance, the operation may be started with installation of brace members 28, 29, etc.

Figure 4:
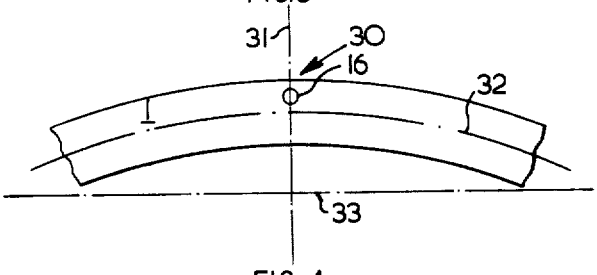
FIG. 4 is a diagrammatic side view, showing a part of an uneven joist, in exaggerated manner.

As to the location of the opening 16 with respect to the apex of unevenness of joist 1, reference my be had to FIG. 4 which shows that the opening 16 is located in the area of the apex 30 of unevenness (a crest in this example) of the joist 1. In general terms, it may therefore be said that the opening 16 is generally coincident with a vertical plane 31 perpendicular to the longitudinal axis 32 of the uneven joist 1, said vertical plane 31 intersecting the apex 30 of unevenness of joist 1. Reference numeral 33 in FIG. 4 represents a horizontal level, to which it is desired to bring the joist 1.

It will thus be appreciated that the present method and apparatus can be applied at virtually any stage of the construction of a floor sub-assembly. The straightener can be easily applied without disturbing the structure. In practice, the straightened joist 1, will assume its straight position after a relatively short period, depending on the type of wood used, temperature, humidity, etc..

Those skilled in the art will appreciate that although the above embodiments of the present invention are preferred, the invention is not limited in scope to same. Various deviations are possible from the embodiments shown, without departing from the scope of the present invention as defined in the accompanying claims.

The embodiments of the present invention in which an exclusive property or privilege is claimed and defined as follows:

1. Method of staightening of a horizontally uneven floor joist made of lumber and comprised in a joist assembly, said joist assembly defining a first generally horizontal level and a second generally horizontal level, said levels being vertically spaced apart and being defined by top and bottom surfaces, respectively, of the joists comprised in said assembly, said method comprising the steps of:

a. providing said uneven joist at said first generally horizontal level with a transversely extending, generally horizontal opening having a longitudinal axis generally coincident with a vertical plane perpendicular to the longitudinal axis of the uneven joist, the said vertical plane intersecting and extreme of unevenness of the joist;

b. inserting into said opening an elongated connecting rod member, whereby the ends of the member protrude to both sides of said uneven joist, adjacent said first generally horizontal level;

c. applying tension to the rod member by subjecting its each respective end to a force directed away of the respective side of said uneven joist and towards said second generally horizontal level;

d. the application of said tension forces being effected by adjustable tension means anchored to joists of said assembly located to both sides of said uneven joist;

e. the anchoring of said tension means being effected in an area adjacent to said second generally horizontal level.

2. Method of claim 1, further comprising the step of securing between said uneven joist and said joists to which the tension means are anchored, elongated, rigid, horizontal brace means in proximity to said second, generally horizontal level.

3. Method as claimed in claim 2, wherein said opening is a drilled opening of circular cross section, the opening being adjacent to but spaced from said first generally horizontal level.

* * * * *